US007394308B1

(12) United States Patent
Stiff et al.

(10) Patent No.: US 7,394,308 B1
(45) Date of Patent: Jul. 1, 2008

(54) CIRCUIT AND METHOD FOR IMPLEMENTING A LOW SUPPLY VOLTAGE CURRENT REFERENCE

(75) Inventors: Jonathon C. Stiff, Beaverton, OR (US); Jay Kuhn, Seattle, WA (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 10/796,859

(22) Filed: Mar. 8, 2004

Related U.S. Application Data

(60) Provisional application No. 60/452,849, filed on Mar. 7, 2003.

(51) Int. Cl.
*G05F 1/10* (2006.01)
*G05F 3/02* (2006.01)

(52) U.S. Cl. ..... 327/543; 323/315; 330/288

(58) Field of Classification Search ..... 327/538, 327/540, 541, 543; 323/313, 315; 330/288
See application file for complete search history.

(56) References Cited

U.S. PATENT DOCUMENTS 3,629,692 A * 12/1971 Goyer ..... 323/315
4,419,542 A * 12/1983 Embree et al. ..... 379/377
4,423,387 A * 12/1983 Sempel ..... 330/85
4,780,624 A * 10/1988 Nicollini et al. ..... 327/541
4,890,052 A * 12/1989 Hellums ..... 323/315
5,144,223 A * 9/1992 Gillingham ..... 323/313
5,621,308 A * 4/1997 Kadanka et al. ..... 323/315
5,637,993 A * 6/1997 Whitney et al. ..... 323/315
5,926,062 A * 7/1999 Kuroda ..... 327/538
5,945,873 A * 8/1999 Antone et al. ..... 327/541
5,955,874 A * 9/1999 Zhou et al. ..... 323/315
6,204,724 B1 * 3/2001 Kobatake ..... 327/541
6,249,176 B1 * 6/2001 Pease ..... 327/538
6,528,979 B2 * 3/2003 Kimura ..... 323/313
6,734,719 B2 * 5/2004 Tanzawa et al. ..... 327/541
6,737,908 B2 * 5/2004 Mottola et al. ..... 327/539
6,799,889 B2 * 10/2004 Pennock ..... 374/178
6,927,622 B2 * 8/2005 Rashid et al. ..... 327/538
7,064,601 B2 * 6/2006 Kwak et al. ..... 327/541
7,071,672 B2 * 7/2006 Drusenthal ..... 323/315
2001/0022527 A1 * 9/2001 Hosono et al. ..... 327/541
2003/0020535 A1 * 1/2003 Young et al. ..... 327/538
2003/0076160 A1 * 4/2003 Inagaki et al. ..... 327/541
2004/0008080 A1 * 1/2004 Nagaya ..... 327/543
2004/0027194 A1 * 2/2004 Morishita et al. ..... 327/543

* cited by examiner

*Primary Examiner*—N. Drew Richards
*Assistant Examiner*—William Hernandez

(57) ABSTRACT

A circuit for generating a reference current, comprising a positive feedback loop, a negative feedback loop, and a floating current mirror coupled to the positive feedback loop. The negative feedback loop may operate to divert current directly from the floating mirror, and may also operate to divert current from the floating mirror by using a voltage follower. The circuit may operate with a minimum supply voltage of approximately the sum of the threshold voltage of a transistor plus three drain saturation voltages, in one example.

14 Claims, 2 Drawing Sheets

CIRCUIT AND METHOD FOR IMPLEMENTING A LOW SUPPLY VOLTAGE CURRENT REFERENCE

CROSS REFERENCE TO RELATED APPLICATION

This application claims the benefit under 35 U.S.C. § 119 (e) to U.S. Provisional Application No. 60/452,849 entitled "A Method for Implementing a Low Supply Voltage Current Reference," filed Mar. 7, 2003, the disclosure of which is hereby incorporated by reference in its entirety.

TECHNICAL FIELD

The present invention relates generally to electronic circuitry and more particularly to current references.

BACKGROUND OF THE INVENTION

Current references are used in many electronic circuits to provide a steady known current as a reference to another circuit. For low power applications, low power current references are desirable as reduced power consumption results in longer operation time for battery powered devices. This is particularly important in mobile applications such as mobile computing, mobile telephony, and mobile gaming.

FIG. 1 shows a conventional implementation of a current reference circuit 30. This implementation comprises positive and negative feedback loops for generating the current reference. The positive feedback loop grows (i.e. amplifies) the current in the load resistor RL. The negative feedback loop keeps the load resistor voltage at approximately VTHN, which is the threshold voltage of an N-type transistor.

In FIG. 1, transistors M2, M4 and M5 and the load resistor comprise the positive feedback loop. For example, if the load resistor current rises, transistor M5 mirrors the current increase to transistor M4, causing an increase in the gate voltage of transistor M2 (shown as signal nn). This raises the load resistor voltage and causes a further increase in current. The positive feedback loop grows the load resistor current until restrained by the negative feedback loop. As such, the positive loop gain must be greater than one, or the loop current will never grow to the reference current. In addition, if the negative feedback loop has less gain than the positive feedback loop, the load resistor current will grow without bound (until the load resistor approaches the supply voltage).

In FIG. 1, the negative feedback loop comprises the load resistor, transistor M1, and transistor M2. For example, if the current through the load resistor rises, so does the gate-source voltage of transistor M1 (shown as the signal nbias). This causes transistor M1 to draw more current, pulling down the gate voltage of transistor M2 (signal nn) and, in turn, reducing the voltage and current across the load resistor.

At the circuit's primary operating point, the load resistor operates with the gate source voltage of transistor M1 across it. If transistor M1 is sufficiently large, the current through the load resistor will be approximately VTHN (the threshold voltage of the N type transistor) divided by R (the load resistor), i.e. current equals (VTHN/R).

As this is a self-generating current reference, this circuit also has a second stable operating point with no current flowing. A conventional startup circuit is required to ensure that the current flows in the circuit to put the circuit of FIG. 1 in the operating point where current is flowing.

In the circuit 30 of FIG. 1, the minimum supply voltage at which this circuit will operate can be characterized by:

$$VPWR(\text{minimum supply voltage})=2*VTH+3*VDSAT$$

As recognized by the present inventors, a disadvantage of conventional circuits such as the circuit 30 of FIG. 1 is the high supply voltage required. In FIG. 1, the minimum supply voltage may be defined by one of two paths in the circuit. No matter which path requires the larger minimum VPWR, shown in Equations 1 and 2, both paths require greater than two MOSFET voltage thresholds. This is a significant voltage level since, as CMOS processes shrink, the maximum supply voltages are shrinking faster than the MOSFET thresholds such that some of the most recent CMOS processes have supply voltages that are little more than two thresholds. Since gate overdrive or saturation voltages (VDSAT) of 100 mV or more are required to keep MOSFET transistors well in saturation, there is often less supply voltage range available than the conventional circuit requires to function.

$$V_{PWR-MIN}(1)=2V_{THN-1,2}+3V_{DSAT-1,2,4} \quad (1)$$

$$V_{PWR-MIN}(2)=V_{THN-1}+V_{THP-5}+3V_{DSAT-1,2,5} \quad (2)$$

Accordingly, as recognized by the present inventors, what is needed is a circuit and method for providing a current reference capable of operating with a reduced supply voltage. It is against this background that embodiments of the present invention were developed.

SUMMARY

According to one broad aspect of one embodiment of the present invention, disclosed herein is a circuit for generating a reference current. In one example, the circuit includes a positive feedback loop coupled with a floating current mirror, and a negative feedback loop diverting current from the floating mirror. The negative feedback loop may divert current directly from the floating mirror, or may divert current from the floating mirror by using a voltage follower. The current mirror may include a pair of p-channel transistors. In one example, the circuit operates with a minimum supply voltage of approximately the sum of a transistor threshold voltage plus three drain saturation voltages.

According to another embodiment of the present invention, disclosed herein is a method for providing a current reference. In one example, the method includes the operations of providing a current mirror circuit portion, providing a positive feedback loop portion coupled with the current mirror, and providing a negative feedback loop portion diverting current from the floating mirror. The operation of providing the current mirror may include providing a pair of p-channel transistors. In one example, the negative feedback loop diverts current directly from the floating mirror.

According to another embodiment of the present invention, disclosed herein is a circuit providing a current reference. In one example, the circuit includes a current mirror including a first transistor (e.g., M5) and a second transistor (e.g., M4); at least one resistor (e.g., R1+R2) defining a voltage node (e.g., Vtn); a pull-down transistor (e.g., M3); and an output transistor (e.g., M7); wherein the first transistor (e.g., M5) is coupled with the at least one resistor (e.g., R1+R2) and provides an amount of current thereto; wherein the second transistor (e.g., M4) is coupled with the output transistor (e.g., M7) for providing a bias signal to the output transistor (e.g., M7); and wherein the amount of current provided by the first transistor (e.g., M5) into the at least one resistor is mirrored to the second transistor (e.g., M4). The load may be coupled to the output transistor such that the load receiving the current reference.

In another example, the pull-down transistor (e.g., M3) has one end coupled with the current mirror and a gate coupled with the voltage node (e.g., Vtn), so as the amount of current provided by the first transistor (e.g., M5) increases, the pull-down transistor (e.g., M3) diverts an amount of current received by the first transistor (e.g., M5).

In one example, the first and second transistors (e.g., M5, M4) are p-channel MOSFETS. The amount of current mirrored to the second transistor (e.g., M4) may provide a bias signal to the output transistor (e.g., M7). The circuit may operate with a minimum supply voltage of approximately the sum of a transistor threshold voltage (e.g., of M3) plus three drain saturation voltages. The pull-down transistor (e.g., M3) may be an n-channel MOSFET, and the output transistor (e.g., M7) may be an n-channel MOSFET, in one embodiment.

In another example, a protection transistor (e.g., M26) may be coupled between the pull-down transistor (e.g., M23) and the current mirror. In one example, the protection transistor may be a p-channel MOSFET.

The features, utilities and advantages of the various embodiments of the invention will be apparent from the following more particular description of embodiments of the invention as illustrated in the accompanying drawings.

DETAILED DESCRIPTION

Figure 1:
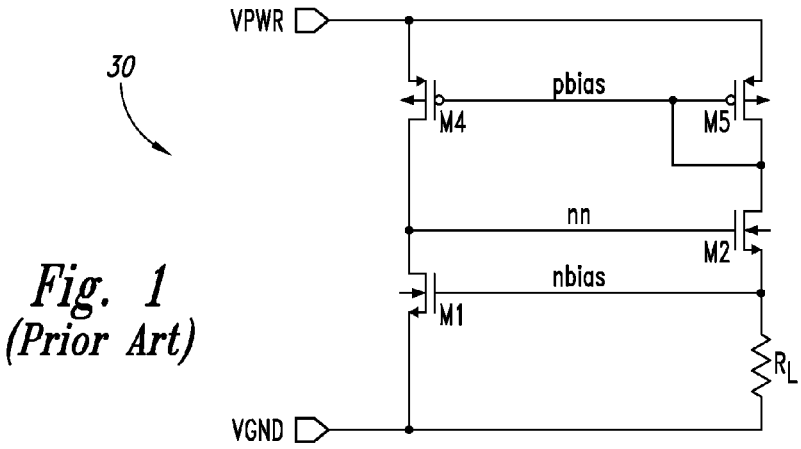
Fig. 1 (Prior Art)
FIG. 1 shows a conventional implementation of a current reference circuit.
Figure 2:
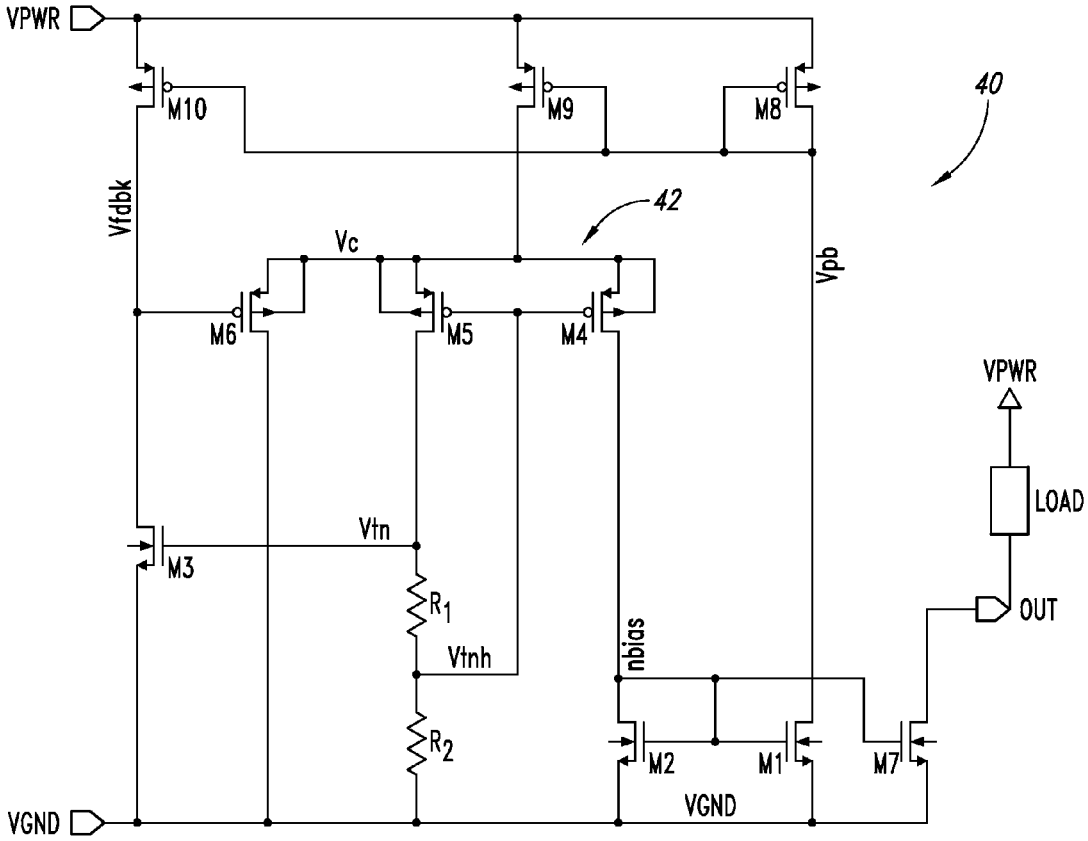
FIG. 2 shows an embodiment of a high gain negative feedback low voltage current reference, in accordance with one embodiment of the present invention.
Figure 3:
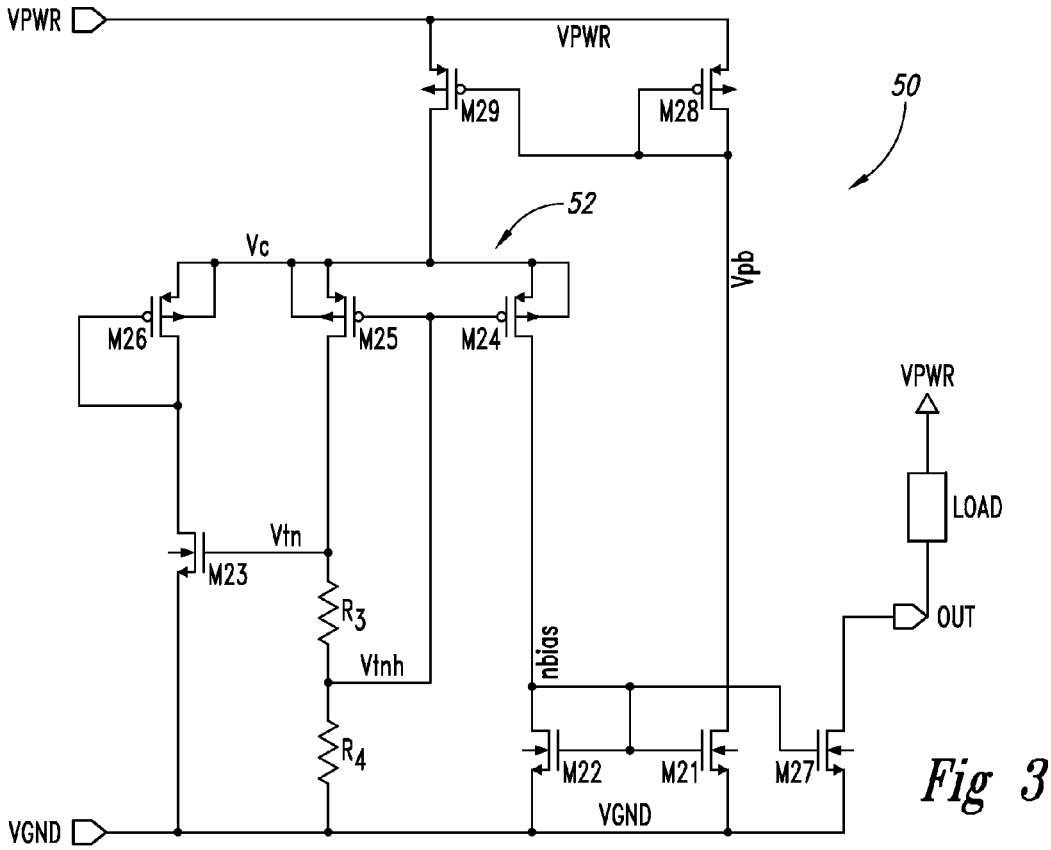
FIG. 3 shows an embodiment of a low gain negative feedback low voltage current reference, in accordance with one embodiment of the present invention.

Disclosed herein are circuits and methods for providing a current reference that may operate using lower supply voltages than required by conventional current references. FIG. 2 illustrates one example of a current reference 40 according to the present invention, while FIG. 3 illustrates another example of a current reference 50 according to the present invention. Generally, a current reference of the present invention may include a positive feedback loop generating current into one or more reference resistors, and a negative feedback loop which counteracts the positive feedback loop. In one example, a floating current mirror is placed in the positive feedback loop, and the negative feedback loop controls the common voltage of the floating current mirror. Various embodiments of the present invention will now be described.

As used herein, the term "transistor" or "switch" includes any switching element which can include, for example, n-channel or p-channel CMOS transistors, MOSFETs, FETs, JFETS, BJTs, or other like switching element or device. The particular type of switching element used is a matter of choice depending on the particular application of the circuit, and may be based on factors such as power consumption limits, response time, noise immunity, fabrication considerations, etc. Hence while embodiments of the present invention are described in terms of p-channel and n-channel transistors, it is understood that other switching devices can be used, or that the invention may be implemented using the complementary transistor types.

In FIG. 2, a current reference 40 is provided for generating a constant current to a load from transistor M7. The current reference circuit 40 may comprise a floating current mirror 42 for the positive feedback loop. The circuit also comprises a negative feedback loop that steals (e.g. diverts) current from the floating mirror.

The circuit 40 of FIG. 2 generates a reference current of VTHN/(R2+R1) with a minimum supply voltage of one MOSFET threshold less than the conventional circuits. The minimum operating voltage required to use the circuit of FIG. 2 may be characterized as:

$$VPWR(\text{minimum supply voltage})=VTH+3*VDSAT$$

where Vth is the threshold voltage of a transistor, and Vdsat is the saturation voltage across the drain to source of a transistor. This is one less threshold voltage (VTH) than is required by the conventional implementation described above. This represents an improvement over the conventional circuits, as this circuit 40 of FIG. 2 can be used in lower-power (low voltage) circuits.

The minimum VPWR paths may be characterized as in Equations 3 and 4.

$$V_{PWR-MIN}(1)=V_{THN-2}+3V_{DSAT-2,4,9} \quad (3)$$

$$V_{PWR-MIN}(2)=V_{THP-6}+3V_{DSAT-3,6,9} \quad (4)$$

In one example, the negative feedback portion of the circuit, which may include transistors M3, M5, M8, and R2, R1, uses a high gain NMOS amplifier to control the load resistor current. In this circuit, however, the voltage at node Vtn is set indirectly by steering the common source voltage of transistor M5 and transistor M4 with the transistor M6 voltage follower. As the current rises through R2 and R1, the gate-source voltage of transistor M3 increases, drawing more current and reducing the gate voltage on transistor M6. This reduces the common source voltage of transistor M4 and transistor M5, stealing current from resistors R2, R1.

Referring to FIGS. 2 and 3, a current reference circuit may include a positive and negative feedback loop. The positive feedback loop may include transistors M1, M2, M8, M9, and M4. The current through resistor R2, R1 is mirrored from transistor M5 to transistor M4 using a floating current mirror and fed back with a gain greater than 1. Since a floating current mirror is used, sensing and regenerating the load resistor current for the positive feedback does not require the additional MOSFET threshold used by a typical current mirror (with source to VPWR or VGND). Instead, the gates of transistor M5 and transistor M4 can be tied to a fraction of the load resistor voltage, allowing their shared source to match their currents. The gate could be tied to VGND if transistor M3 of the negative feedback loop did not require any Vds saturation voltage. Often very little saturation voltage is required, as transistor M3 is large.

In one example in FIG. 2, a current reference 40 may include a positive feedback loop that generates current into one or more resistors R1, R2, and the positive feedback loop may include transistors M1, M2, M8, M9, and M4. The current reference 40 may also include a floating current mirror including transistors M4 and M5. A negative feedback loop may include transistors M3, M5, M6, and resistors R1, R2.

In FIG. 2, P-channel transistor M10 and N-channel transistor M3 are connected in series between the VPWR and VGND. P-channel transistor M6 and P-channel transistor M5 are connected in parallel with their sources coupled together, and the gate of transistor M6 is coupled with the drains of transistor M3 and M10. The drain of transistor M6 is coupled with VGND. The drain of transistor M5 is coupled with the gate of transistor M3 and the series combination of resistors R1 and R2. The gate of transistor M5 is coupled with the node between resistors R1 and R2, and is also coupled with the gate of P-channel transistor M4. Transistor M4 has its source coupled with the sources of transistors M5 and M6, and the drain of transistor M4 is coupled with the drain of N-channel transistor M2. The source of transistor M2 is coupled with VGND, and the gate of transistor M2 is coupled with its drain, along with the gate of N-channel transistor M1.

Transistor M1 has its source coupled with VGND, and its drain coupled with the drain of transistor M8. P-channel transistors M8 and M9 each have their sources coupled with VPWR, and the gate and drain of transistor M8 are coupled with the drain of transistor M1. The gate and drain of transistor M8 are also coupled with the gate of transistor M9 which is coupled with the gate of transistor M10. The drain of transistor M9 is coupled with the sources of transistors M4, M5, and M6. N-channel transistor M7 has its gate coupled with the gate and drain of transistor M2. The source of transistor M7 is coupled with VGND, and the drain of transistor M7 forms the output node for providing a current reference to a load. In FIG. 2, unless otherwise shown, the substrates on n-channel devices are coupled with VGND, while the wells of p-channel devices are coupled with VPWR.

In operation, assuming that transistor M5 has some current running through it via a conventional start-up circuit, the current through transistor M5 is mirrored in transistor M4, which biases transistor M2. The biasing of transistor M2 sets the current in transistor M1, as well as the current in transistor M8 and transistor M9, which then goes back through transistors M5 and M4. The current mirror 42 formed by transistors M5 and M4 split the received current from transistor M9 into two portions. The current through transistor M5 may be part of the positive feedback loop, and to the extent the positive feedback loop has a positive gain greater than 1, the negative feedback loop prevents the current from growing boundlessly.

As the positive feedback loop increases current through resistors R1 and R2, the voltage across these resistors increases to the point where transistor M3 turns on which pulls down the voltage on the node Vfdbk, and as that voltage decreases, the gate of transistor M6 is pulled down which pulls current off of the node VC hence, diverting current away from the positive feedback loop. The negative feedback loop continues to divert current until a point where the current being taken away by the negative feedback loop directly cancels the current that the positive feedback loop is adding into resistors R1, R2, thereby the voltage at node Vtn remains constant.

As the voltage at node Vtn approaches the threshold voltage of transistor M3, the current through the resistors R1, R2 is then mirrored by transistor R5 and transistor R4, which biases transistor M2. Transistor M2 generates a bias voltage that is used at the gate of transistor M7 to provide a current reference to the load attached to transistor M7.

In FIG. 2, there may be a significant amount of amplification between the gate of M3, which is Vtn, and the drain of M3 which is Vfdbk. This configuration with high impedance makes this feedback loop to be high gain. Being high gain, this configuration can set the voltage through the gate-source of M3 across resistors R2, R1 with very little error. Since this is a high gain feedback loop, it will need some larger devices to ensure stability for that loop. A typical feedback compensation would be a large capacitor between Vfdbk and ground.

In another embodiment of FIG. 3, a low-gain current reference 50 is provided for providing a constant current to a load through transistor M27. The low gain nature of the circuit of FIG. 3 may result in more variations in the current reference provided over process, temperature and voltage.

In one example, a current reference 50 may include a positive feedback loop that generates current into one or more resistors R3, R4, and the positive feedback loop may include transistors M21, M22, M28, M29, and M24. The current reference may also include a floating current mirror 52 including transistors M24 and M25. A negative feedback loop may include transistors M23, M25, M26, and resistors R3, R4.

In FIG. 3, P-channel transistor M28 and N-channel transistor M21 are connected in series between VPWR and VGND. The gate of transistor M21 is coupled with the gate and drain of N-channel transistor M22. Transistor M22 has its source coupled with ground. The gate and drain of transistor M22 are coupled with the drain of P-channel transistor M24. Transistor M24 has its gate coupled with the gate of P-channel transistor M25, which has its drain coupled to the series combination of resistors R3 and R4. The gates of transistor M24 and M25 are coupled with the resistor divider between resistors R3 and R4, while the sources of transistors M24, M25 are coupled together and coupled with the source of P-channel transistor M26. The drain and gate of transistor M26 are coupled together and with the drain of N-channel transistor M23. The source of transistor M23 is coupled with ground, while the gate is coupled with the drain of transistor M25 and the series combination of resistors R3 and R4.

P-channel transistor M29 has its source coupled with the VPWR and its gate coupled with the source and drain of transistor M28. The drain of transistor M29 is coupled with the sources of transistors M24, M25, and M26. N-channel transistor M27 has its gate coupled with the gate of transistor M21 and the gate and drain of transistor M22. The source of transistor M27 is coupled with VGND, while the drain provides the output current reference for providing a current to a load as needed.

In FIG. 3, unless otherwise shown, the substrates on n-channel devices are coupled with VGND, while the wells of p-channel devices are coupled with VPWR. In one example, a conventional start-up circuit for a current reference may be employed in order to provide current into transistor M25.

In operation, the circuit 50 of FIG. 3 works essentially in a similar manner as the circuit of FIG. 2, except that transistor M23 is directly stealing or diverting current away from the positive feedback loop. The transistor M26 drops the voltage VC on to transistor M23. Hence, transistor M26 prevents the possibility that transistor M23 will over-pull the VC node down which may disrupt the operation of the positive feedback loop, and in this regard, transistor M26 performs a protection function. In particular, if transistor M23 begins to consume too much current, transistor M26 turns transistor M23 off, thereby limiting the amount of current that transistor M23 can take from the positive feedback loop.

As with FIG. 2, transistor M23 provides the voltage across resistors R3, R4 to be approximately the threshold voltage of transistor M23 and therefore the current through these resistors. The current then gets mirrored from transistor M25 to transistor M24, which then generates a bias signal to transistor M22 which feeds the gate of transistor M27 to provide the current reference to the lode attached to transistor M27.

Referring to FIG. 3, transistor M23 directly removes current provided by the positive feedback path without buffering. This results in a lower gain negative feedback loop, causing greater output current vs. VPWR variation, as shown in FIG.

4. However, this implementation requires less capacitance for negative feedback compensation and would reduce layout area in an implementation where the greater VPWR sensitivity was acceptable.

The circuits of FIGS. 2-3 can replace conventional circuits in existing analog CMOS applications to generate a current reference, and provide the very low VPWR required without significantly increasing in size compared to the conventional implementation. In addition, the resistor values may be approximately the same size as the conventional circuits.

Figure 4:
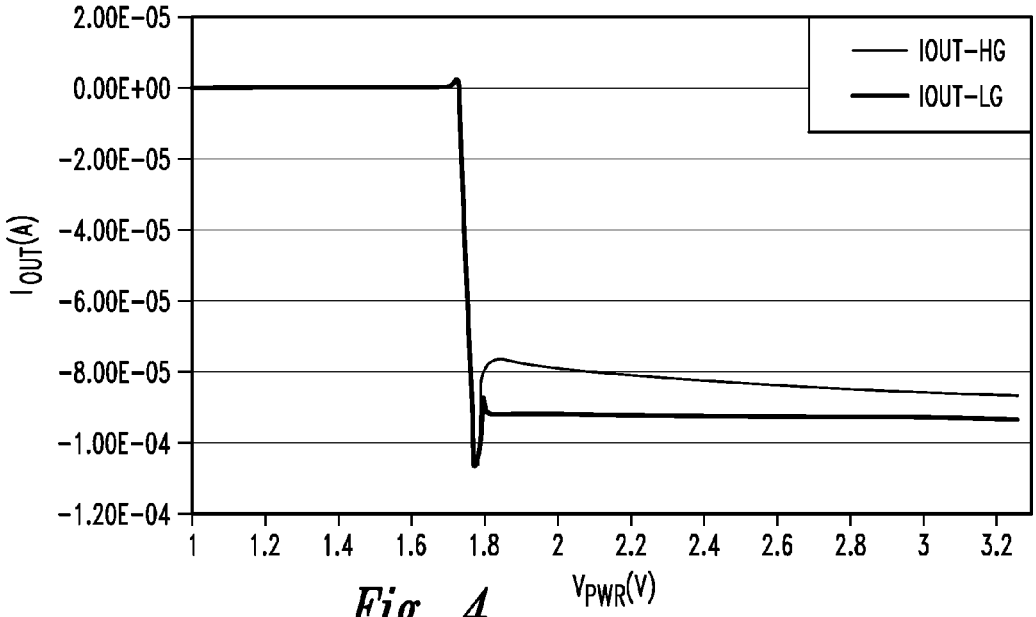
FIG. 4 shows a graph of a low and high gain output current (IOUT) vs. supply voltage (VPWR) for one possible implementation of the invention in a 5V CMOS process.

In FIGS. 2-3 the output node is marked 'OUT', and the output current (IOUT) flows from this node. FIG. 4 shows the output current (IOUT) vs. supply voltage (VPWR) for the circuit implementations in FIGS. 2 and 3 using a 5V CMOS process (with no low threshold MOSFETs, in one example). The label 'IOUT –HG' refers to the output current of the high gain embodiment in FIG. 2. The label 'IOUT –LG' refers to the output current of the low gain embodiment in FIG. 3. As shown in FIG. 4, the output current begin to be delivered at approximately 1.8 volts in this example.

Although a plurality of embodiments of the circuit have been described above, alternate embodiments are also possible. The circuit, like most CMOS circuits, has a complementary counterpart where NMOSFETs and PMOSFETs can be switched as well as VPWR and VGND. In addition, the load resistor for the circuit can be implemented with any passive resistance material, for example polysilicon, nwell, etc. or even with an active device operating as a resistive element. The negative feedback portion of the circuit can be implemented in a first embodiment for high gain (shown in FIG. 2) or in a second embodiment for low gain (shown in FIG. 3). These methods contrast on the amount of IOUT/VPWR rejection they provide and amount of negative feedback loop compensation required. Specifically, the lower gain loop would generally require smaller devices to achieve stability than the higher gain loop. In one embodiment, lag compensation can be implemented by adding a capacitor from the high gain node (node vfdbk in FIG. 2 for example) in the negative feedback loop to AC ground.

Embodiments of the present invention can be used in a variety of circuits where current references may be used, such as in non-volatile memory circuits, programmable logic devices, semiconductors, microprocessors or micro-controllers, logic or programmable logic devices, clock circuits, or the like.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" means that a particular feature, structure or characteristic described in connection with the embodiment is included in at least one embodiment of the present circuit. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

While the invention has been particularly shown and described with reference to embodiments thereof, it will be understood by those skilled in the art that various other changes in the form and details may be made without departing from the spirit and scope of the invention.

What is claimed is:

1. A circuit for generating a reference current, comprising:

a positive feedback loop coupled with a floating current mirror, the floating mirror having a plurality of transistors;

a negative feedback loop diverting current from the floating current mirror;

wherein the circuit operates with a minimum supply voltage of approximately the sum of a transistor threshold voltage plus three drain saturation voltages;

wherein each source node of the plurality of transistors forming the floating current mirror are directly coupled together;

wherein the source node of each transistor forming the floating current mirror is not directly coupled to a ground node; and wherein the source node of each transistor forming the floating current mirror is not directly coupled to a supply voltage node.

2. The circuit of claim 1, where the negative feedback loop diverts current directly from the floating current mirror.

3. The circuit of claim 1, where the negative feedback loop diverts current from the floating current mirror by using a voltage follower.

4. The circuit of claim 1, wherein the floating current mirror comprises a floating MOSFET current mirror.

5. The circuit of claim 4, wherein the floating MOSFET current mirror includes a pair of p-channel transistors.

6. A circuit providing a current reference, comprising:

a floating current mirror including a first transistor and a second transistor;

at least one resistor defining a voltage node;

a pull-down transistor coupled with the floating current mirror; and an output transistor;

wherein the first transistor is coupled with the at least one resistor and provides an amount of current thereto;

wherein the second transistor is coupled with the output transistor for providing a bias signal to the output transistor;

wherein the amount of current provided by the first transistor into the at least one resistor is mirrored to the second transistor; and wherein the pull-down transistor has one end coupled with the floating current mirror and a gate coupled with the voltage node, so as the amount of current provided by the first transistor increases, the pull-down transistor diverts an amount of current received by the first transistor.

7. The circuit of claim 6, wherein the amount of current mirrored to the second transistor provides a bias signal to the output transistor.

8. The circuit of claim 6, wherein the pull-down transistor is an n-channel MOSFET.

9. The circuit of claim 6, wherein the output transistor is an n-channel MOSFET.

10. The circuit of claim 6, further comprising:

a protection transistor coupled between the pull-down transistor and the floating current mirror.

11. The circuit of claim 10, wherein the protection transistor is a p-channel MOSFET.

12. The circuit of claim 6, wherein a load is coupled to the output transistor, the load receiving the current reference.

13. The circuit of claim 6, wherein the first and second transistors are p-channel MOSFETS.

14. The circuit of claim 6, wherein the pull-down transistor is coupled with the floating current mirror through a MOSFET transistor.

* * * * *